United States Patent [19]

Fujii et al.

[11] Patent Number: 4,458,628

[45] Date of Patent: Jul. 10, 1984

[54] APPARATUS FOR APPLYING ADHESIVE TO AUTOMOBILE WINDSHIELD GLASS PANELS

[75] Inventors: Hiroshi Fujii; Sunji Sakamoto, both of Hiroshima, Japan

[73] Assignee: Toyo Kogyo Co., Ltd., Hiroshima, Japan

[21] Appl. No.: 418,073

[22] Filed: Sep. 14, 1982

[30] Foreign Application Priority Data

Sep. 16, 1981 [JP] Japan ..... 56-146912
Mar. 10, 1982 [JP] Japan ..... 57-38675

[51] Int. Cl.[3] ..... B05C 5/02

[52] U.S. Cl. ..... 118/697; 118/698; 118/409; 118/321

[58] Field of Search ..... 118/697, 698, 321, 320, 118/409

[56] References Cited

U.S. PATENT DOCUMENTS 3,403,658 10/1968 Damm et al. ..... 118/409
3,575,131 4/1971 Lohmann ..... 118/321 X
3,606,162 9/1971 Lehmann ..... 118/697 X
3,785,898 1/1974 Gerber et al. ..... 118/697 X
4,357,900 11/1982 Buschor ..... 118/697 X

FOREIGN PATENT DOCUMENTS 55-18132 4/1980 Japan .
54-68346 12/1980 Japan .

*Primary Examiner*—John P. McIntosh
*Attorney, Agent, or Firm*—Fleit, Jacobson, Cohn & Price

[57] ABSTRACT

An apparatus for applying adhesive to automobile windshield glass panels which includes a turn table assembly for supporting a glass panel and moving it so that the peripheral portion of the glass panel is continuously exposed to an adhesive applying nozzle which is supported by an industrial robot. A control circuit such as a microprocessor is provided and has a first memory of the order in which different types of glass panels are supplied and a second memory including informations as to the controls of the turn table and the nozzle for applying adhesive to respective ones of the glass panel. The control circuit determines the type of the glass panel which is mounted on the turn table in accordance with the first memory and address to the second memory so as to control the movement of the turn table and the nozzle.

6 Claims, 11 Drawing Figures

APPARATUS FOR APPLYING ADHESIVE TO AUTOMOBILE WINDSHIELD GLASS PANELS

The present invention relates to apparatus for applying adhesive to automobile windshield glass panels. More particularly, the present invention pertains to apparatus for automatically applying adhesive to windshield glass panels of different sizes and different shapes.

In automobile body structures, windshield glass panels are adhesively attached to bodies by at first applying adhesives to peripheral portions of the glass panels and then bringing the glass panels to the body to thereby bond the glass panels at the peripheral portions to the bodies. In this process, it has been recognized that it is very difficult to establish automatic procedures for applying the adhesives to the peripheral portions of the glass panels since the glass panels have complicated, three dimensional curvatures.

Japanese utility model publication No. 55-18132 discloses an automatic adhesive applying device which includes a guide frame having a peripheral configuration identical with that of the windshield glass panel which is to be applied with adhesive. The guide frame is carried by a rotatable table so that it is rotated by the table together with the glass panel. A follower mechanism is provided so as to be moved by the peripheral portion of the guide frame to thereby control the position of an adhesive applying nozzle which is adapted to apply a desired amount of adhesive to the peripheral portion of the glass panel. The apparatus as disclosed by the Japanese utility model publication is considered as being able to accomplish automatic application of adhesive to windshield glass panels having a certain configuration. However, the apparatus is disadvantageous in that it is very complicated in structure and it cannot be used where glass panels of several configurations are to be handled.

It is therefore an object of the present invention to provide relatively simple means for automatically applying adhesive to automobile windshield glass panels.

Another object of the present invention is to provide automatic adhesive applying means which can handle glass panels of different configurations.

A further object of the present invention is to provide automatic adhesive applying means which can apply adhesive accurately to the peripheral portions of glass panels without having risk of damaging the glass panels.

According to the present invention, the above and other objects can be accomplished by an apparatus for applying adhesive to predetermined portions of windshield glass panels of various configurations, said apparatus including turn table means for holding one of the glass panels, locating means provided on said turn table means for locating said one glass panel in a predetermined position, means for rotating said turn table means about an axis intersecting said glass panel, applying nozzle means for discharging a controlled amount of adhesive, controllable actuator means carrying said nozzle means so that inclination angles of said nozzle means can be changed at least about two perpendicular axes, processor means containing memories of a known order in which the glass panels of various configurations are supplied to the turn table means and of control informations as to controls of said turn table rotating means and said actuator means in applying adhesive to each of said glass panels of various configurations so that the memories of the control informations are appropriately addressed in accordance with the memories of said order of supply of the glass panels whereby the nozzle means can apply adhesive to said predetermined portions of the glass panels.

In a preferable aspect of the present invention, the turn table means or the actuator means may be provided for displacement in at least one direction perpendicular to said axis of rotation of the turn table means. The actuator means may further be movable in a direction substantially parallel with the axis of rotation of the turn table means so that the nozzle means on the actuator means can be moved to and from the glass panel on the turn table means. According to the present invention, it is possible to perform automatic application of adhesive to windshield glass panels of various configuratians.

The above and other objects and features of the present invention will become apparent from the following description of preferred embodiments taking reference to the accompanying drawings, in which.

Figure 8:
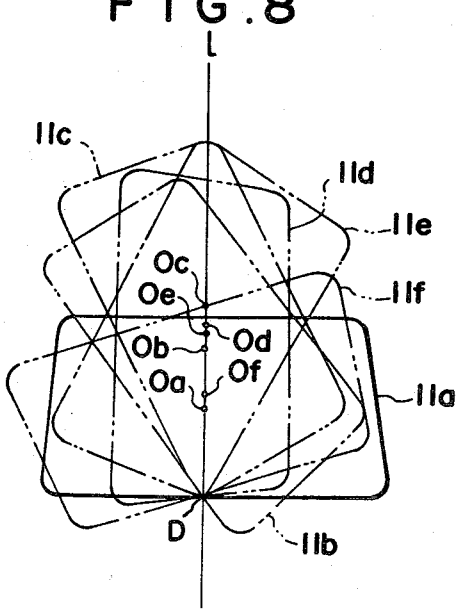
Figure 7:
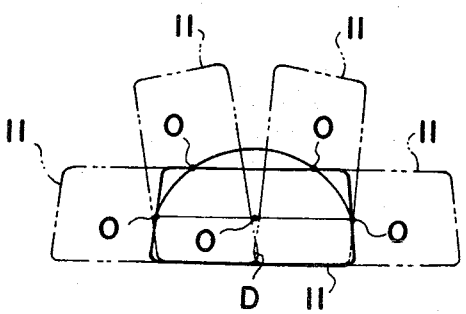
Figure 6C:
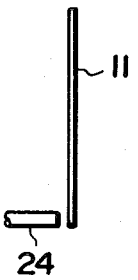
Figure 6A:
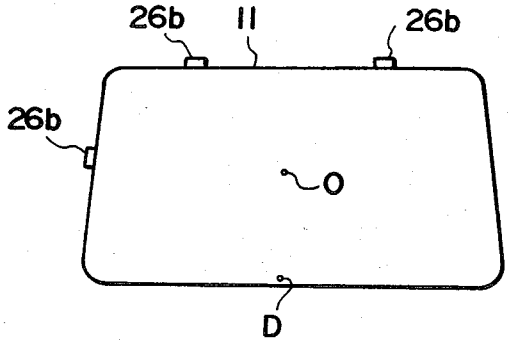
Figure 6B:
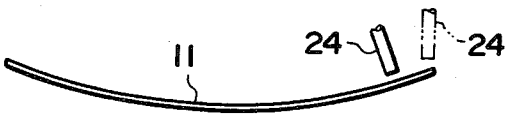
Figure 9:
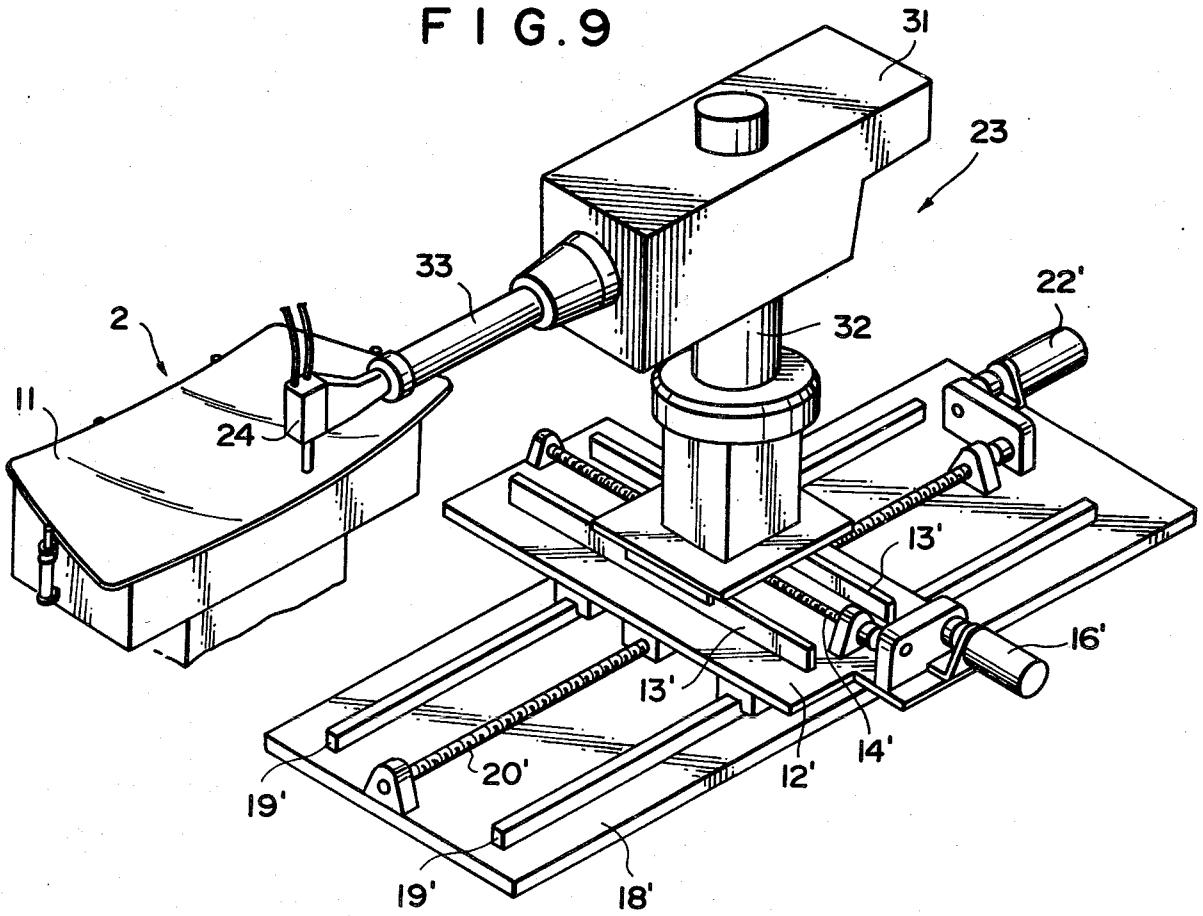

FIG. 6(*a*), (*b*) and (*c*) show control of the adhesive applying nozzle with respect to the glass panel;

FIG. 7 shows an example of operation of the turn table;

FIG. 8 shows another example of operation of the turn table; and,

FIG. 9 is a perspective view showing a further embodiment.

Referring now to the drawings, particularly to FIGS. 1 through 4, the adhesive applying apparatus A shown therein includes a turn table assembly 2 which includes a turn table 5 mounted rotatably on a carriage 3 through a bearing 4. The turn table 5 is provided with a drive shaft 5*a* extending vertically downwardly from the center of the turn table 5. The lower end of the drive shaft 5*a* is connected with a multiple stage speed changing gear box 6 which is in turn connected with a rotating DC servomotor 7 so as to drive the turn table 5 at a desired speed.

Figure 4:
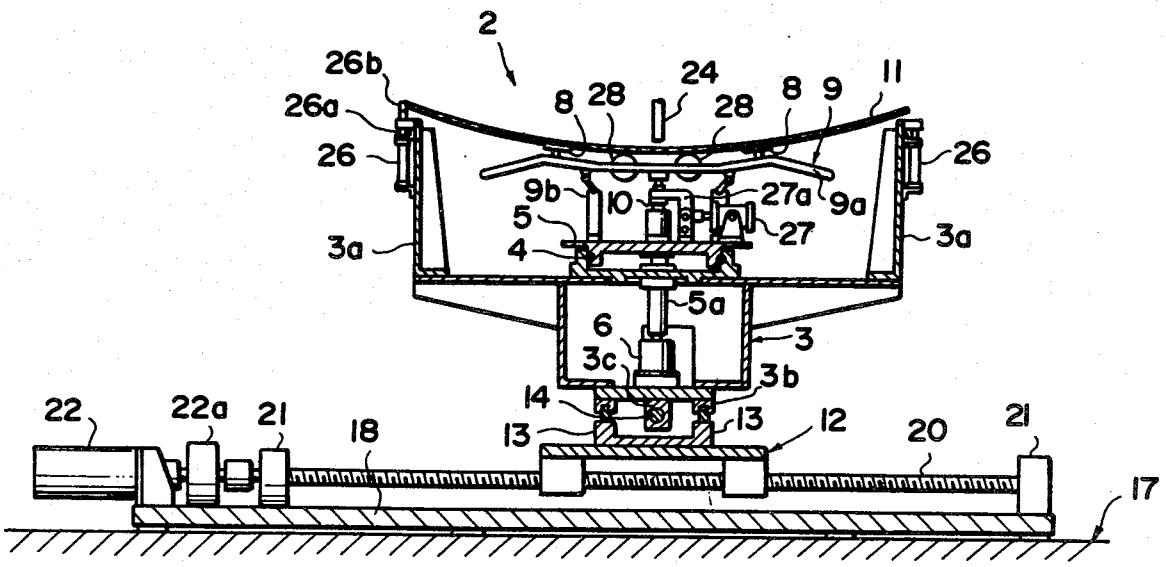
FIG. 4 is a vertical sectional view of the adhesive applying apparatus.

On the turn table 5, there is a windshield glass panel fixing frame assembly 9 which includes a hollow fixing frame 9*a* provided with a plurality of vacuum cups 8. The fixing frame assembly 9 is supported and connected by a plurality of support legs 9*b* on the turn table 5 at its central portion through a vacuum coupler 10 which is provided on the central portion of the turn table 5 with a vacuum pump (not shown), so that the fixing frame 9*a* is supplied with vacuum from the vacuum pump through the vacuum coupler 10 to thereby apply the vacuum to the vacuum cups 8. The hollow fixing frame 9 may be provided with one or more vacuum tanks 28 as shown in FIG. 4. A coupler disconnecting cylinder 27 is provided on the turn table 5 and connected through a linkage 27*a* with the coupler 10 so that the coupler 10 can be disconnected by actuating the cylinder 27.

Figure 3:
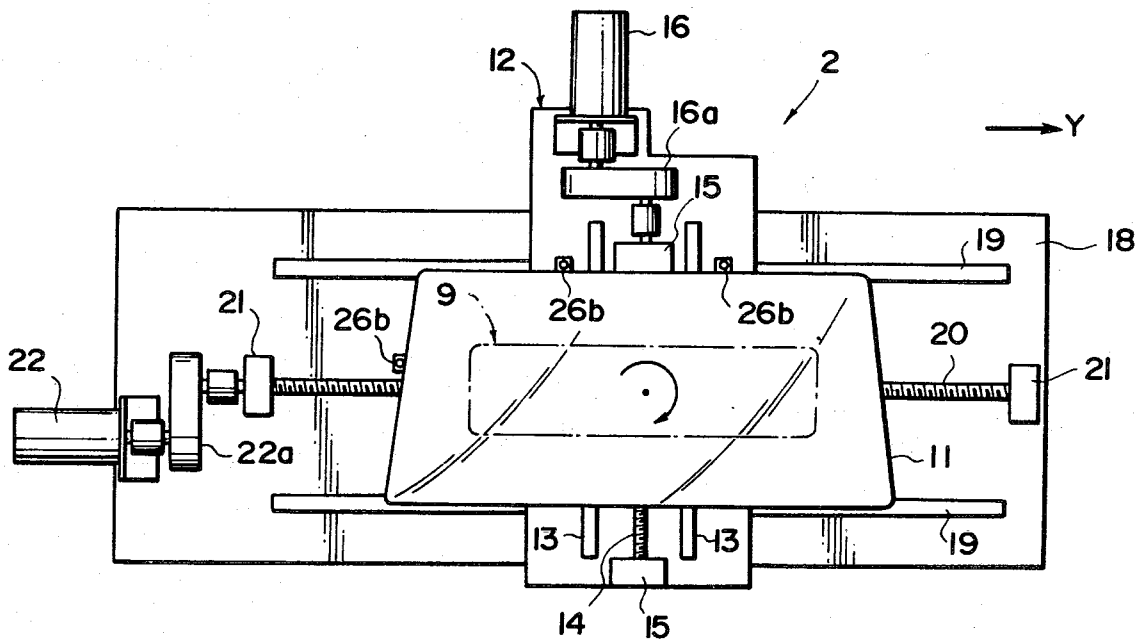
FIG. 3 is a plan view specifically showing the turn table mechanism.

The carriage 3 has an upright peripheral wall which carries a plurality of glass panel positioning cylinders 26. The positioning cylinders 26 are vertically disposed and have upwardly extendable piston rods 26*a* provided respectively with glass panel positioning shoes 26*b*. It will be therefore be understood that a windshield glass panel 11 which is to be applied with adhesive can be located at a desired position by extending the piston rods 26*a* of the positioning cylinders 26 and placing the glass panel 11 in contact at its peripheral edges with the positioning shoes 26*b* on the piston rods as shown in FIGS. 3 and 6. Then the cylinder 27 is actuated to connect the frame 9*a* with the vacuum source to thereby apply vacuum to the vacuum cups 8. After the glass panel 11 is thus gripped, the piston rods 26*a* of the cylinders 26 are retracted so that the glass panel 11 can be rotated with the turn table 5.

The carriage 3 is provided at its bottom with a pair of parallel guide grooves 3*b* which are engaged with a pair of parallel guide rails 13 provided on a movable plate 12. On the movable plate 12, there is further provided a driving screw 14 which is mounted for rotation by mounting brackets 15 and adapted to be driven through a speed reduction gear 16*a* by an electric motor 16. The carriage 3 has a nut 3*c* which is secured thereto and adapted to be engaged with the driving screws 14 so that the carriage 3 can be driven along the guide rails 13. The movable plate 12 is also provided at the bottom surface thereof with guide grooves (not shown) which are engaged with a pair of parallel guide rails 19 provided on a base plate 18 to extend perpendicularly to the guide rails 19. The base plate 18 is further provided with a driving screw 20 which is rotatably supported by bracket 21 and connected through a speed reduction gear mechanism 22*a* with a motor 22 so that the movable plate 12 can be driven by the motor in a direction perpendicular to the direction in which the carriage 3 is driven by the motor 16.

Figure 1:
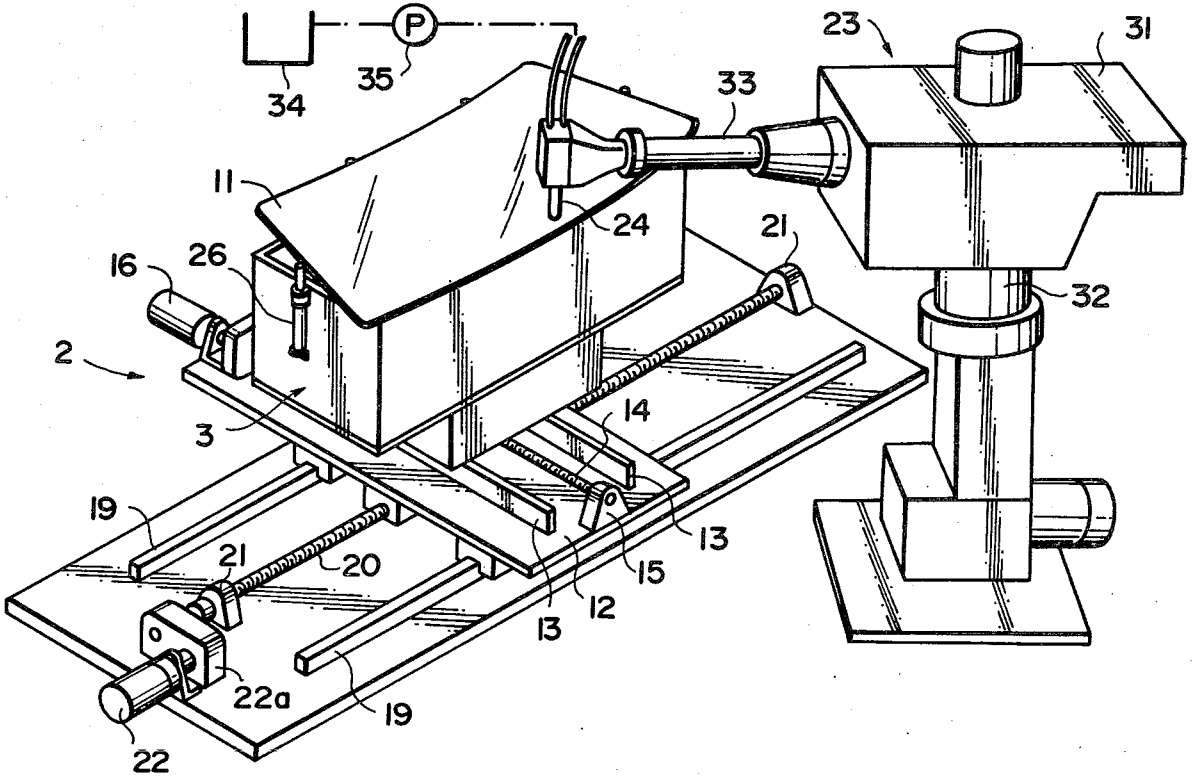
FIG. 1 is a perspective view of an adhesive applying apparatus in accordance with one embodiment of the present invention.
Figure 2:
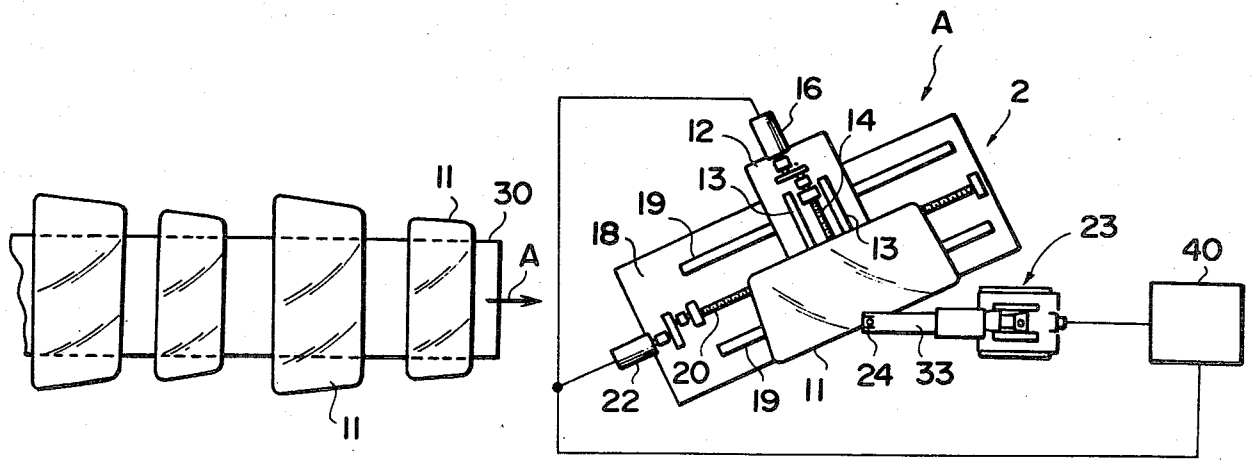
FIG. 2 is a plan view of the apparatus shown in FIG. 1.

As shown in FIG. 2, a conveyor 30 is provided adjacent to the turn table assembly 2 so that a plurality of glass panels 11 are transported in a direction shown by an arrow A. The glass panels 11 may be of different sizes and configurations for use in different types of automobiles but such glass panels 11 of different sizes and configurations are transported in a known order.

Adjacent to the turn table assembly 2, there is provided a nozzle actuating apparatus 23 which is in the form of an industrial robot having a body 31 supported by a vertical mast 32. A nozzle carrying arm 33 is provided so as to extend horizontally from the body 31 and carries an adhesive applying nozzle 24 which is mounted on the free end of the arm 33 for swinging movement about a vertical axis perpendicular to the axis of the arm 33. The arm 33 is rotatable about its own axis so that the nozzle 24 can be swung in any desired direction to change its direction of inclination. To rotate the arm 33 and swing the nozzle 24 about the aforementioned axes, appropriate servomotors are provided in the robot 23. The vertical mast 32 is movable in a vertical direction by a hydraulic cylinder so that the vertical position of the nozzle 24 can be adjusted by moving the mast 32. For the purpose, an appropriate hydraulic servovalve is provided. The nozzle 24 is connected with a source 34 of adhesive through a feed pump 35 so that the nozzle 24 is appropriately supplied with adhesive.

Figure 5:
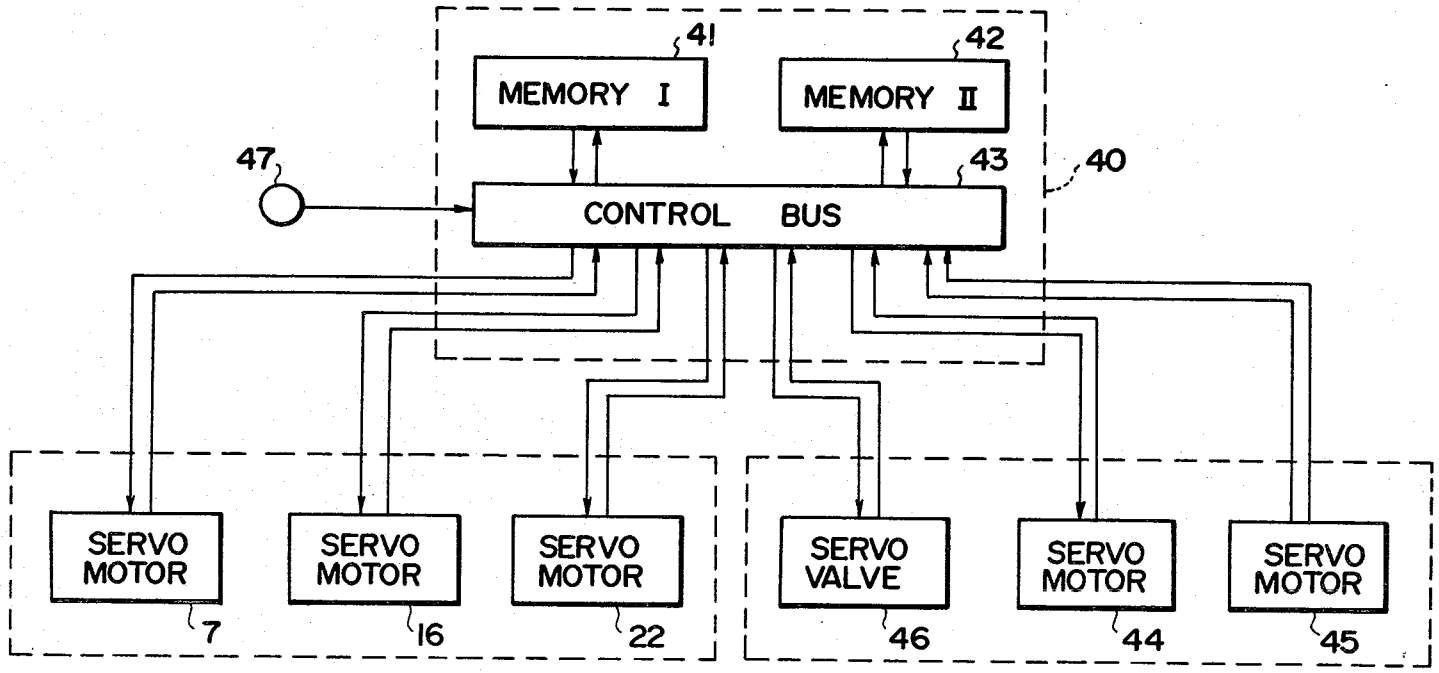
FIG. 5 is a circuit diagram showing the control circuit used in the adhesive applying apparatus.

There is also provided a control circuit for controlling the operation of the turn table assembly 2 and the robot 23 so that the glass panel 11 on the turn table assembly 2 is applied with adhesive at peripheral portions. Referring to FIG. 5, the control circuit is designated by the reference numeral 40 and may be in the form of a microprocessor. The control circuit 40 includes a first memory 41 corresponding to the order of the types of the glass panels 11 supplied by the conveyor 30 and a second memory 42 having memories of sequence and amounts of actuations of the servo-motors 7, 16 and 22 for the turn table assembly 2 and those of the motors and the servovalve for the robot 23. The control circuit 40 further has a control bus 43 which is connected with the servomotors 7, 16 and 22 for the table assembly 2, the servomotors for controlling the orientation of the nozzle 24 and the servovalve for controlling the vertical position of the nozzle 24. In FIG. 5, the servomotor for rotating the arm 33 about its axis is designated by the reference numeral 44 whereas the servomotor for swinging the nozzle 24 by the reference numeral 45. Further, the servovalve for controlling the vertical position of the nozzle 24 is designated by the reference numeral 46. Further, a manually operated switch such as a foot switch 47 is connected with the control bus 43.

In operation, an operator places the glass panels 11 one by one on the turn table assembly 2 in the order supplied by the conveyor 30. The glass panel 11 is located on the frame 9*a* by the positioning cylinders 26 under the procedure described previously and the cylinder 27 is actuated to place the vacuum coupler 10 in the coupling position so that the glass panel 11 is gripped by the vacuum cups 8. Then, the positioning cylinder 26 is actuated to the retracted position to make the glass panel 11 rotatable with the turn table 5. The manually operated switch 47 is then actuated to start the operation of the control circuit 40. The control circuit 40 at first judges the type of the glass panel 11 which is mounted on the turn table assembly 2 from the informations stored in the first memory 41 and then addresses to a specific one of the memories in the second memory 42 which corresponds to the specific type of the windshield glass 11 determined in accordance with the first memory 41. The control bus 43 in the circuit 40 produces appropriate outputs in accordance with the addressed one of the memories in the second memory 42 and applies these outputs to the servomotors 7, 16, 22, 44 and 45 and the servovalve 46. The servomotors 7, 16 and 22 are energized so that the adhesive applying nozzle 24 is placed above a point D on the peripheral portion of the glass panel 11 mounted on the turn table assembly 2 and the glass panel 11 is then moved by rotating the turn table 5 and displacing the carriage 3 along the guide rails 13 and the guide rails 19, whereby succesive portions of the periphery of the glass panel 11 are continuously exposed to the nozzle 24 as shown in FIG. 7. The servovalve 46 is actuated so that the nozzle 24 is located at a proper distance from the glass panel 11 as shown by FIGS. 6(*b*) and (*c*). The servomotors 44 and 45 are actuated so that the nozzle 24 is directed substantially perpendicularly to the surface of the glass panel 11 as shown by solid lines in FIG. 6(*b*) even when the curvature of the glass panel 11 changes. When the glass panel 11 is rotated by a full turn and the periphery of the glass panel 11 is fully exposed to the nozzle 24, the operation of the circuit is interrupted to complete one cycle of operation. Then, the glass panel 11 is removed and a succeeding glass panel 11 is mounted on the turn table assembly 2 for a next cycle of operation. It should of course be noted that instead of moving the carriage 3, the industrial robot 23 may be moved in the same way by mounting it on a carriage assembly as the turn table assembly in the previous embodiment. Such embodiment is shown in FIG. 9 in which like numerals designate corresponding parts. Since the operations are similar, detailed descriptions will not be made.

It is of course possible to mount the plate 12 stationary so that the carriage 3 is movable only in one direction. In this case, the movement of the carriage 3 is related with the rotation of the turn table 5 as shown in FIG. 8 so that the periphery of the glass panel is continuously exposed to the nozzle 24 which is located at the position D. In FIG. 8, the suffixes a through f designate the sequence of operations.

The invention has thus been shown and described with reference to specific embodiments, however, it should be noted that the invention is in no way limited to the details of the illustrated structures but changes and modifications may be made without departing from the scope of the appended claims.

We claim:

1. An apparatus for applying adhesive to predetermined portions of windshield glass panels of various configurations, said apparatus comprising:

turn table means for holding one of the glass panels, locating means provided on said turn table means for locating said one glass panel in a predetermined position, means for rotating said turn table means about an axis intersecting said glass panel, adhesive applying nozzle means for discharging a controlled amount of adhesive, controllable actuator means carrying said nozzle means so that inclination angles of said nozzle means can be changed at least about two perpendicular axes, said actuator means including means for moving said nozzle means toward and away from said turn table means so that the distance between the nozzle means and the glass panel on the turn table means can be adjusted, processor means including memories containing a known order in which the glass panels of various configurations are supplied to the turn table means and containing control information for control of said turn table rotating means and said actuator means in applying adhesive to each of said glass panels of various configurations so that the memories containing the control information are appropriately addressed in accordance with the memories containing said order of supply of the glass panels, whereby the nozzle means can apply adhesive to said predetermined portions of the glass panels.

2. An apparatus in accordance with claim 1 in which said turn table means is movable at least in one linear direction in a substantially horizontal plane.

3. An apparatus in accordance with claim 1 in which said turn table means is movable in two perpendicular linear directions in a substantially horizontal plane.

4. An apparatus in accordance with claim 1 in which said actuator means is movable at least in one linear direction in a substantially horizontal plane.

5. An apparatus in accordance with claim 1 in which said actuator means is movable at least in two perpendicular directions in a substantially horizontal plane.

6. An apparatus for applying adhesive to predetermined portions of windshield glass panels of various configurations, said apparatus comprising:

turn table means for holding one of the glass panels, locating means provided on said turn table means for locating said one glass panel in a predetermined position, means for rotating said turn table means about an axis intersecting said glass panel, conveyor means for supplying the glass panels of various configurations in a known order so that the glass panels can be sequentially placed on the turn table means in said order, adhesive applying nozzle means for discharging a controlled amount of adhesive, controllable actuator means carrying said nozzle means so that inclination angles of said nozzle means can be changed at least about two perpendicular axes, said actuator means including means for moving said nozzle means toward and away from said turn table means so that the distance between the nozzle means and the glass panel on the turn table means can be adjusted, processor means including memories containing said order in which the glass panels are supplied and containing control information for control of said turn table rotating means and said actuator means in applying adhesive to each of said glass panels of various configurations so that the memories containing the control information are appropriately addressed in accordance with the memories containing said order of supply of the glass panels, whereby the nozzle means can apply adhesive to said predetermined portions of the glass panels.

* * * * *